US005213438A

United States Patent [19]

Bärenwald

[11] Patent Number: 5,213,438

[45] Date of Patent: May 25, 1993

[54] CHEMICAL SAFETY TRENCH DRAIN CONDUIT

[75] Inventor: Jörg R. Bärenwald, Concord Township, Lake County, Ohio

[73] Assignee: Aco Polymer Products, Inc., Chardon, Ohio

[21] Appl. No.: 802,899

[22] Filed: Dec. 6, 1991

[51] Int. Cl.[5] ..... B01D 35/34; E01F 5/00

[52] U.S. Cl. ..... 404/2; 405/118

[58] Field of Search ..... 404/2, 3, 4, 5; 405/118, 119, 120, 121, 126

[56] References Cited

U.S. PATENT DOCUMENTS

| | | | |
|---|---|---|---|
| 3,225,545 | 12/1965 | Flegel | 404/2 X |
| 4,940,359 | 7/1990 | Van Duyn et al. | 405/118 |
| 5,066,165 | 11/1991 | Wofford et al. | 405/119 |

OTHER PUBLICATIONS

"Aco Drain Product Catalogue & Installation Notes," No. 5.19/Aco, Nov. 1984.

*Primary Examiner*—William P. Neuder

*Attorney, Agent, or Firm*—Watts Hoffmann Fisher & Heinke

[57] ABSTRACT

A safety trench drain conduit formed of first and second trench drain elements each in the form of an open top channel having imperforate bottom and sidewall portions. The first trench drain element is located and retained within the second trench drain element and is constructed and arranged to allow liquid access thereto from outside the second trench drain element. The second trench drain element bottom and sidewall portions envelope those of the first trench drain element. The second, outer, trench drain element sidewall portions include transverse surfaces above and laterally outward of and sloped inwardly toward the first trench drain element to direct any seepage near the entrance of the trench drain toward the open top of the first trench drain element. Longitudinally extending lateral flanges extending from an adjacent and upper portion of the sidewalls of the first element overlie and are supported by transverse longitudinally extending surfaces of the second element in order to support the first element within the second and to provide a space between an outside bottom surface of the first element and an inside bottom surface of the second element. The space extends essentially the length of the trench drain and is suitable for collecting liquid that may leak or pass through the first element. The height of the first element sidewalls increases from a first end to a second end while the height of the second element sidewalls is constant thereby providing a longitudinal slope to the first trench drain element relative to the second. Longitudinal frame rails secured at the opening to the inner trench drain element support a perforate trench drain cover. The trench drain is installed in a floor or the like with the cover flush with the surrounding surface and the upper ends of the outer element sidewalls beneath and covered by the surrounding surface, where it is protected from wear and tear.

16 Claims, 4 Drawing Sheets

CHEMICAL SAFETY TRENCH DRAIN CONDUIT

TECHNICAL FIELD

This invention relates to safety trench drains for chemical fluids and more particularly to a safety trench drain conduit having an inner trench drain element and an outer trench drain element for collecting chemical liquids.

BACKGROUND ART

Trench drain conduits of polymer concrete have found many uses where high strength and durability justify the increased cost over tile, concrete and other ceramic materials. Such drains are typically channel-shaped trench drains, open at the top, and recessed into a surface, such as a floor, to catch liquid run-off from spills or leaks. However, where the liquid that may spill or leak or otherwise require collection is environmentally unsafe, such as hazardous chemical liquids, the Environmental Protective Agency of the U.S. Government has required secondary containment in addition to the primary container to inhibit any such liquid from escaping into the environment.

A previous chemically safe trench drain that provides secondary containment utilizes a double-walled trench drain disclosed in U.S. Pat. No. 4,940,359. That trench drain is formed of two initially separate channel members pre-assembled, one within the other, of convenient modular length for shipment, assembly and use, and that can conveniently be joined, one to the next, in a sealed relationship during installation. The inner and outer channel members are formed of cast polymer concrete, i.e., a resin and a refractory filler.

This previous double-channeled trench system is relatively expensive and in many cases is sturdier than necessary. In addition, to assure flow within the trench system, it and the floor in which it is installed must slope from one end of the trench toward a drain, which can be disadvantageous.

DISCLOSURE OF THE INVENTION

This invention provides a double-walled trench drain especially suitable for use as a safety trench drain for collecting or conveying, or both, chemical fluids in an environmentally safe manner. The trench drain is constructed to guard against leakage, is chemically resistant, non-porous and structurally strong. In addition, a first or inner element of the trench drain slopes longitudinally relative to an outer element to cause liquid within the inner wall to flow, typically toward a drain or collection point. An alternative embodiment has a variable longitudinal slope between sections of the inner element to provide a self-cleaning feature and maximizes the flow capacity and velocity within the inner element. A first section will have the steepest longitudinal slope while a second subsequent section will have a lesser slope and a third subsequent section an even lesser slope.

In a preferred embodiment of the invention, the trench drain is formed of first and second trench drain elements each in the form of an open-topped channel having imperforate bottom and sidewall portions. The first trench drain element is located and retained within the second trench drain element and is constructed and arranged to allow liquid access thereto from outside the second trench drain element. The second trench drain element bottom and sidewall portions envelope those of the first trench drain element. The second, outer, trench drain element sidewall portions include transverse surfaces above and laterally outward of and sloped inwardly toward the first trench drain element to direct any seepage near the entrance of the trench drain toward the open top of the first trench drain element.

The inside bottom surfaces of the first and second elements are, at least in part, sloped transversely. This allows liquid to gather in the center of each element which improves flow within the first element and allows any liquid in the second element to be easily detected by a liquid detector element.

Longitudinally extending lateral flanges extending from and adjacent an upper portion of the sidewalls of the first element overlie and are supported by transverse longitudinally extending surfaces of the second element. This arrangement supports the first trench drain element within the second trench drain element and provides a space between an outside bottom surface of the first element and an inside bottom surface of the second. The space extends essentially the length of the trench drain and is suitable for collecting liquid that may leak or pass through the first element. A seal is between the lateral flanges of the first element and the longitudinally extending supporting surfaces.

Each element is formed of discrete sections that have interengaging ends. The interengaging ends of the sections are adhered together and sealed in a manner that prevents leakage between sections.

The distance between the first trench drain element inner bottom surface and the second trench drain element inner bottom surface decreases in the longitudinal direction to provide a longitudinal slope to the first trench drain element relative to the second.

Longitudinal frame rails secured at the opening to the inner trench drain element support a perforate trench drain cover. The trench drain is installed in a floor or the like with the cover flush with the surrounding surface and with the upper ends of the outer element sidewalls beneath and covered by the surrounding surface, where it is protected from wear and tear.

The inner trench drain element in the preferred embodiment is formed of fiberglass, while the outer trench drain element is formed of polymer concrete, i.e., a resin and a refractory filler. Most preferably, the resin is a vinyl polymer or a polyester polymer and the filler is predominantly or entirely quartz. With these materials, the trench drain or trench is non-porous, impervious to attack by frost, oil, most acids and alkalis, and will withstand impact, vibration and heavy localized loadings. The outer trench drain element is up to approximately four times the strength of an equivalent cement concrete channel.

The longitudinal slope of the first trench drain element allows any liquid which enters the first trench drain element to flow within the first trench drain element. This allows liquid run-offs, spills and any other source of liquid for the trench to be easily collected and disposed of without the need to slope the entire trench and/or the floor within which it is installed.

Thus, the invention provides an elongate safety trench drain for collecting liquids comprising first and second trench drain elements each in the form of an open-topped, channel-shaped member having substantially liquid impermeable bottom and sidewall portions. The first trench drain element is located and retained within the second trench drain element and is constructed and arranged to receive liquid through the open top. The second trench drain element envelopes the first trench drain element. Support structure for supporting the first trench drain element within the second trench drain element is provided wherein at least a portion of the outside bottom surface of the first element is above the inside bottom surface of the second element to provide a space therebetween. The space extends essentially the length of the trench drain and is suitable for collecting liquid that may leak through the first element. The distance between the first trench drain element inner bottom surface and the second trench drain element inner bottom surface decreases to provide a longitudinal slope of the first trench drain element relative to the second.

These and other features of the invention will be better understood from the detailed description that follows, when considered in connection with the accompanying drawings.

BEST MODE FOR CARRYING OUT THE INVENTION

Figure 1:
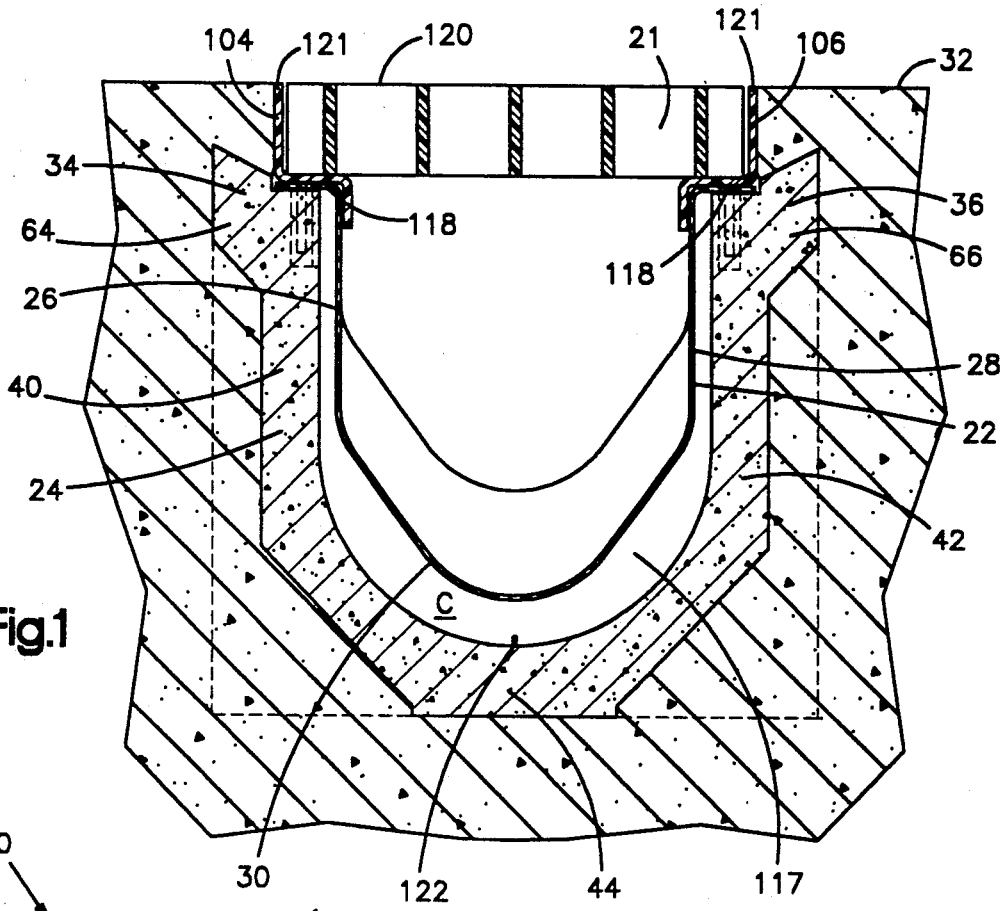
FIG. 1 is cross-sectional view of a trench drain embodying the invention installed in a ground surface as seen approximately from the plane indicated by the line 1—1 in FIG. 2.

With reference to the drawings, a trench drain 20 is shown embodying the invention. The preferred embodiment shown is constructed for use as a safety trench drain conduit and is covered with a grate 21 or the like through which liquid can pass into the trench drain. In use, the top of the grate 21 will be flush with a surface from which liquid run-off is to be collected. The trench drain finds primary use in collecting and conveying environmentally unsafe liquids that may find their way to a surface in which the trench drain is located. To reduce the chance of leakage from the trench drain, it is made of first and second trench drain elements, an inner element 22 and an outer element 24 that envelopes the inner element. For convenience and ease of shipping and for accommodating trenches of various lengths, the elements 22, 24 are made of discrete sections joined end-to-end. Sealant is used between adjoining ends to bond the sections together and to prevent leakage of liquid therebetween. Sections of trench drain different in shape from that shown are contemplated, including end sections for terminating a trench drain, T-shaped sections and L-shaped sections for joining trenches or changing direction, as well as other shapes for specialized purposes.

The inner element 22 is comprised of opposite and parallel sidewalls 26, 28 and a bottom wall 30, which are imperforate and liquid impermeable. In the preferred embodiment, bottom wall 30 is concave, substantially V-shaped in cross section. The sidewalls 26, 28 are substantially vertical with reference to a ground surface 32. Each inner element has an inner surface 27 and an outer surface 29.

Longitudinally extending lateral flanges 34, 36 are located at an upper proportion of the sidewalls 26, 28 and extend outwardly therefrom. The flanges 34, 36 include a plurality of holes 38.

An end 35 of each section of the inner element is enlarged to receive an overlapped opposite end **35*a* of an adjacent section. As a result, the inner surfaces 27 of two adjoining inner element sections are flush. To prevent leakage between the adjoining sections, a sealant is applied to the inside surface of the enlarged end 35 before the opposite end 35*a*** is put into place.

Figure 2:
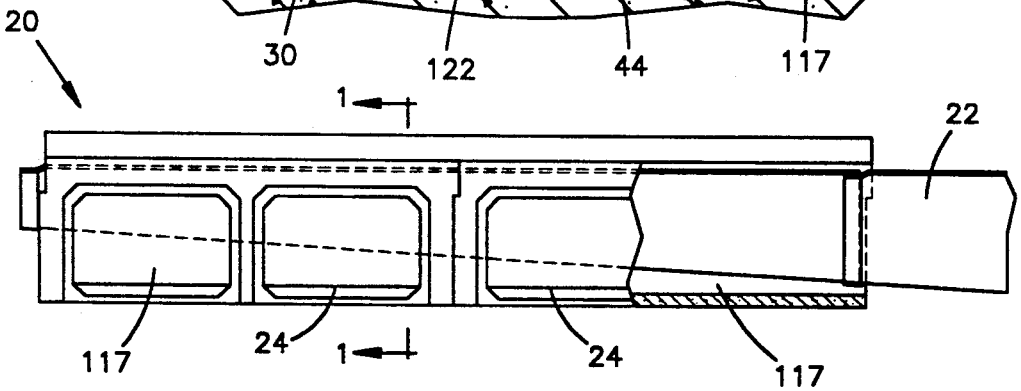
FIG. 2 is an elevational view of a trench drain embodying the invention with a partial cross-section.
Figure 3:
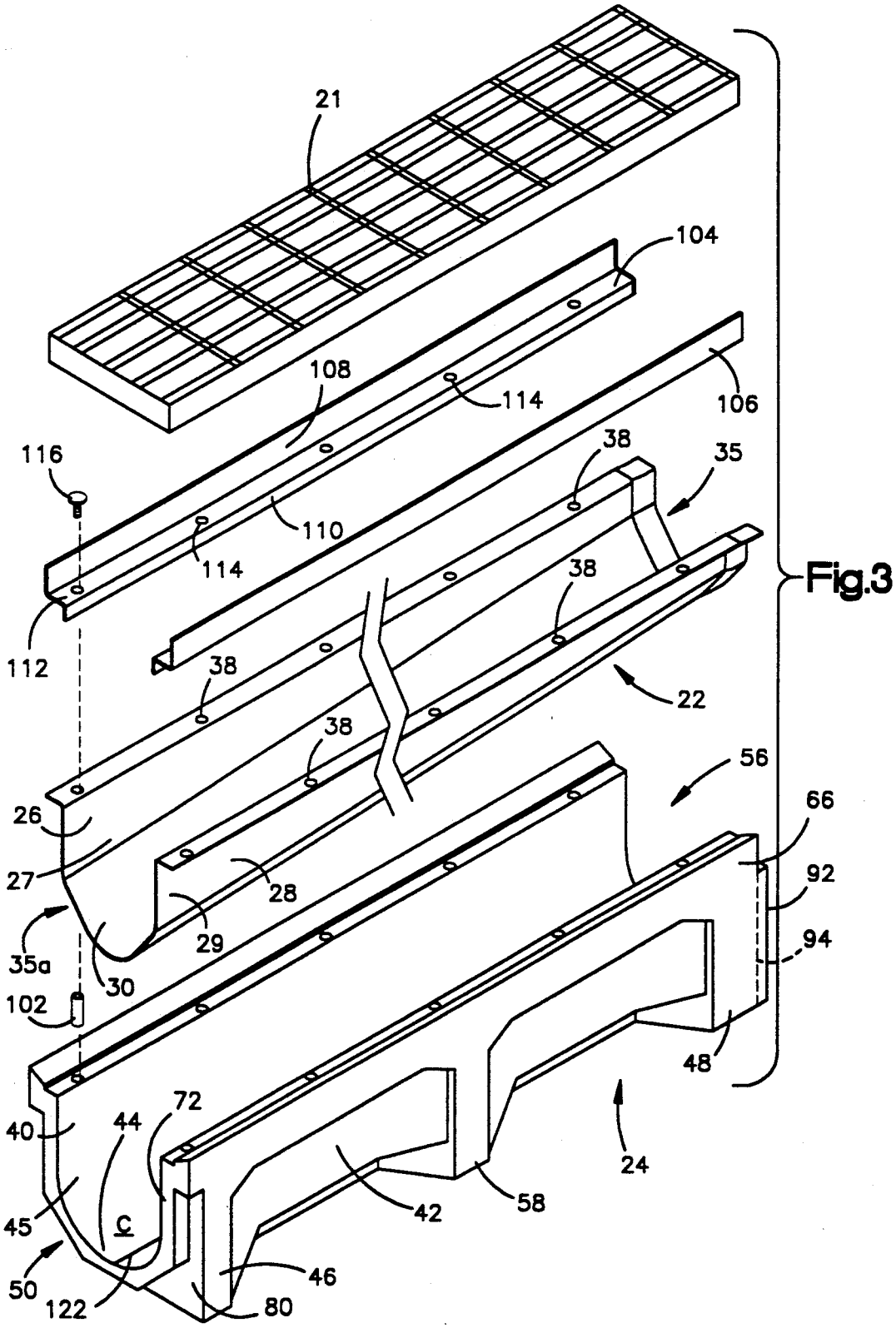
FIG. 3 is an exploded view of the trench drain embodying the invention.
Figure 4A:
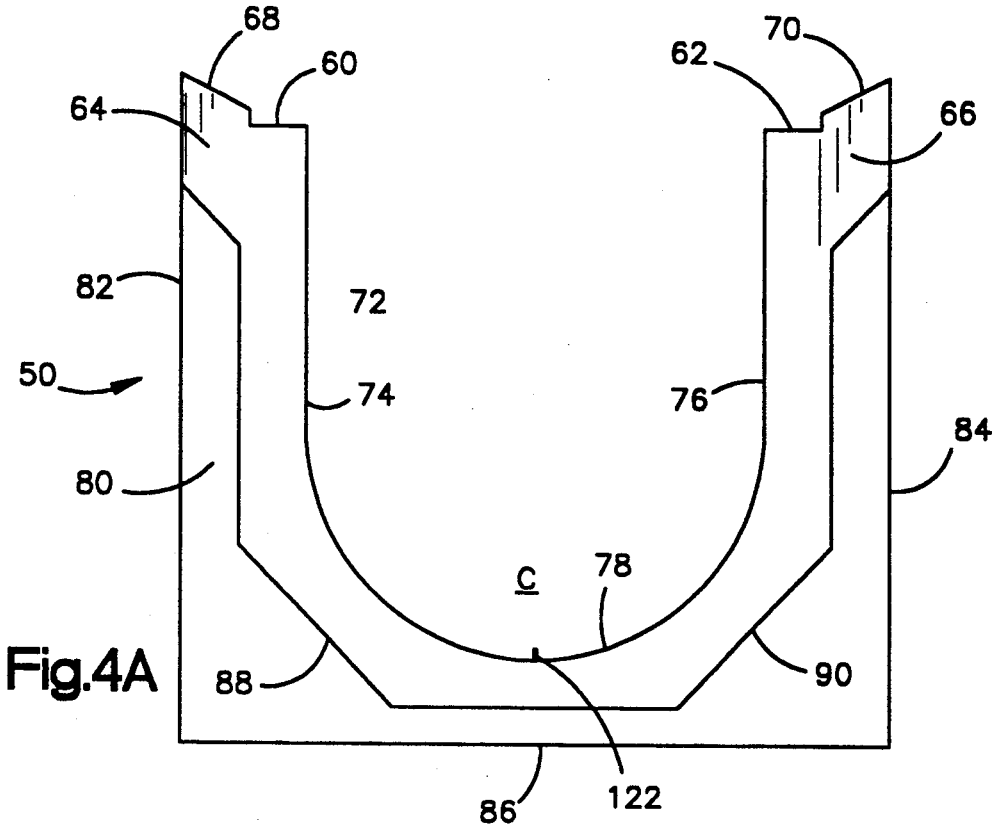
FIG. 4A is an elevational view of a left end of an outer element of the trench drain illustrated in FIG. 3.
Figure 4B:
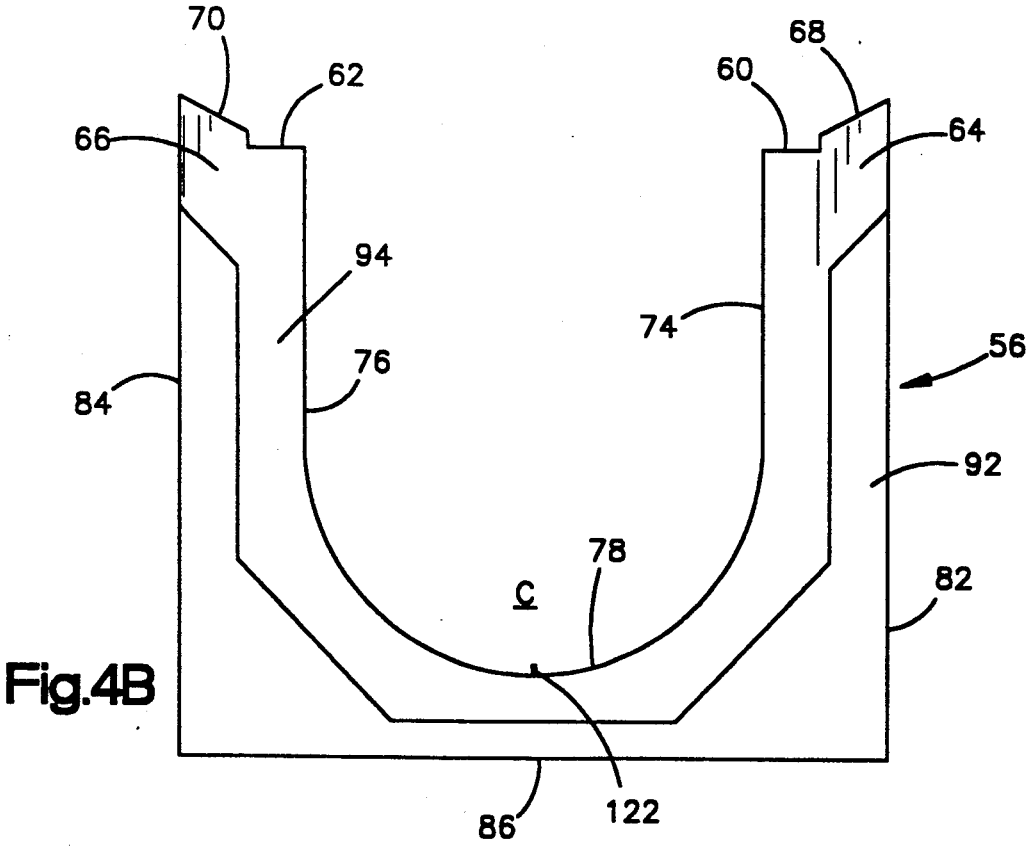
FIG. 4B is an elevational view of a right end of an outer element of the trench drain illustrated in FIG. 3.
Figure 5:
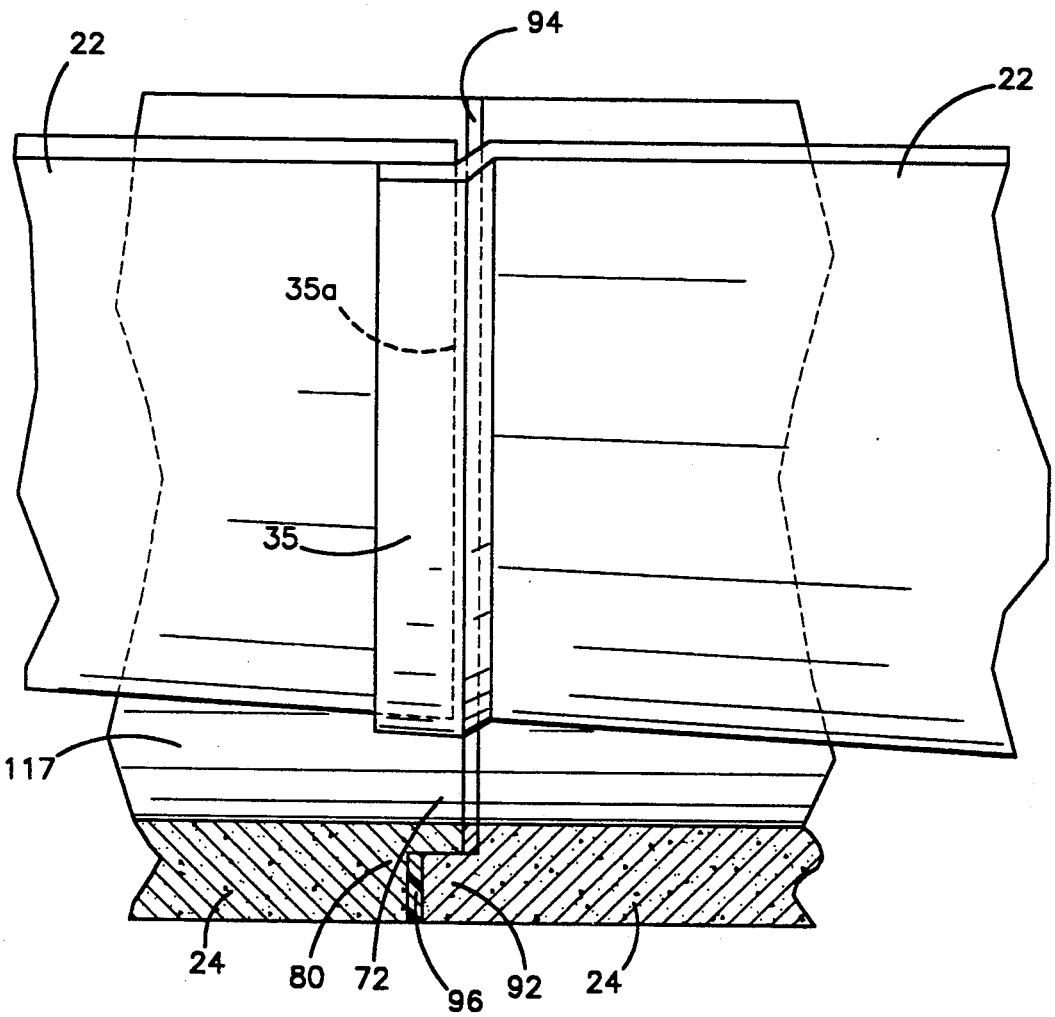
FIG. 5 is a partial cross sectional view of two broken adjacent sections of the trench drain embodying the invention.

As shown in exaggerated scale in FIGS. 2 and 3, the vertical height of the sidewalls 26, 28 increases in the longitudinal direction from end 35 to end **35*a*. This provides a longitudinal slope of the bottom wall 30 of the inner element 22** to facilitate liquid movement longitudinally of the trench.

The outer element 24 is greater in width and depth than the inner element 22, to closely receive and envelope the inner element 22 and to accommodate the longitudinal slope of the inner element while providing a space beneath the inner element to collect any fluid leakage. It is comprised, of solid, opposite and parallel, sidewalls 40, 42 and a bottom wall 44, which is imperforate and liquid impermeable. The sidewalls 40, 42 and the bottom wall 44 are arranged such that the inner surface 45 of the outer element 24 is substantially U-shaped. Preferably the outer element is formed of abutting discrete sections that are rigid and strong, advantageously molded or cast. The sidewalls 40, 42 have thicker reinforcing portions at each end, a portion 46 at an end 50 and a portion 52 at an opposite end 56. A third reinforcing portion 58 is located between the two ends 50, 56.

An upper portion of each sidewall 40, 42 includes a ledge 60, 62, which extends the length of the element 24. Each sidewall 40, 42 has a seepage flange 64, 66, above and laterally outward of the ledge, extending the length of the element 24. Top surfaces 68, 70 of the flanges are sloped inwardly toward the respective ledges 60, 62.

An end 50 of each section of the outer element 24 has a first U-shaped end surface inner periphery 72 contiguous with inner sidewall surfaces 74, 76, and with an inner bottom wall surface 78, and has a second U-shaped end surface 80 forming the outer periphery of the end surface, contiguous with outer sidewall surfaces 82, 84, and with an outer bottom wall surface 86. Outer intermediate surfaces 88, 90 are located between sidewall surface 120, 122 and bottom wall surface 124. The other end 56 of the outer element 24 has a first U-shaped end surface outer periphery 92 contiguous with surfaces 82, 84, 86, and a second U-shaped end surface inner periphery 94, contiguous with the surfaces 74, 76, 78. As shown in FIGS. 3, 4A, 4B and 5, the outer end surface 80 is recessed with respect to the inner end surface 72, while the inner end surface 94 is recessed with respect to the outer end surface 92. The depth of the recess formed by the end surface 94 relative to the end surface 92 at the end 56 is slightly greater than that of the recess formed by the end surface 80 with respect to the end surface 72 at the end 50 to accommodate a sealant adhesive 96 between the surfaces 94 and 72.

It is, therefore, apparent that to join two adjacent outer element sections 24, the end 50 of a first section interengages the end 56 of an adjacent section. A sealant 96 bonds the interengaged ends and prevents leaks therebetween.

The inner bottom wall surface 78 is concave transversely of the longitudinal extent of the element, increasing the depth along a longitudinal center line C, which is the lowest level of the bottom inside wall. This construction serves to direct and collect any liquid that lies on the bottom inside wall into a limited area of increased depth to facilitate detection of the liquid.

When the trench drain 20 is assembled, the flanges 34, 36 of the inner element 22 overlie and are supported by the transverse ledges 60, 62 of the outer element 24. Retainers, such as inserts 102, located within the transverse surfaces 60, 62 are aligned with the holes 38 located in the flanges 34, 36. Fiberglass frame rails 104, 106 overlie and are supported by the flanges 34, 36. The frame rails comprise oppositely extending and laterally offset vertical portions 108 and 110. The vertical portions are offset by transverse portions 112. The transverse portions 112 have a plurality of holes 114 aligned with the flange holes 38 and inserts 102. Each lower vertical portion 108 cooperates with the adjacent inner element sidewall to properly locate the frame rail and thereby properly locate the upper vertical portion 110. Fasteners 116, such as rivets or threaded fasteners, preferably of stainless steel, extend through the flange and rail holes and into the inserts to hold the frame rails, inner element and outer element together.

The grate 21 is supported by the frame rails 104, 106, resting on the transverse portion 112 of each frame rail and located in the transverse direction of the trench drain 20 by the upper vertical portion 110.

As shown in FIG. 2, the height of the sidewalls 40, 42 of the outer element 24 is constant and greater than that of the sidewalls 26, 28 of the inner element 22, so as to completely envelope the sidewalls of the inner channel. A clearance or space 117 is provided between bottom walls of the inner and outer. The space 117 extends the length of the trench drain 20 but decreases in height due to the longitudinal slope of the inner element 22 relative to the outer element 24. The height of the sidewalls 40, 42 of the outer element 24 is great enough to ensure the existence of the space between the elements the entire length of the trench drain 20. Therefore, the height of both elements is dictated by the length of the trench drain 20 in order to ensure that the outer element completely envelopes the inner element and that a space exists between the inner bottom wall 30 and the outer bottom wall 44. FIGS. 2 and 3 are not to scale and have been exaggerated to illustrate what is actually a gradual longitudinal slope of the inner element 22 relative to the outer element 24.

A seal element 118, which also serves as an adhesive in the preferred embodiment, is placed between flanges 34, 36 and the corresponding transverse ledge surfaces 60, 62. The seal 118 extends the entire length of the trench drain 20 and provides a liquid-proof seal between the inner element and outer element to prevent liquid from entering the outer element between the two elements. Because the seepage flanges 64, 66 are located above the flanges 34, 36, they direct any liquid that might seep through the ground surface 32 adjacent the drain toward and into the inner channel 22.

Once the trench drain is mounted within the ground, a top surface 120 of the grate 21 is flush with the ground surface 32. A top surface 121 of each frame rail upper vertical portion 110 is also flush with the ground surface. In addition, the seepage flanges 64, 66 are located within the ground and below the ground surface 32. This prevents any portions of the outer element 24 from being subjected to wear and tear from heavy objects or machinery that traverse the ground surface and which may utilize metal wheels or skids.

A liquid detector element indicated diagrammatically as a longitudinal detector wire 122 in FIGS. 1, 3, 4A and 4B is preferably located in the outer element along the central area C where the depth of any collected liquid is greatest. The detector may be of any known type, but one type has a detecting wire or the like that would extend along the trench drain and serve to signal the presence of liquid in the space between the elements, which may result from any breach of the integrity of the trench drain construction that would result in leakage from the inner channel to the outer.

In the preferred embodiment, when the trench drain 20 is being installed, one section of the inner element 22, having an effective longitudinal length of six feet (plus a nominal amount of length for overlapping the ends 35 and 35*a*), is used with two sections of the outer element 24, each three feet in longitudinal length.

Figure 6:
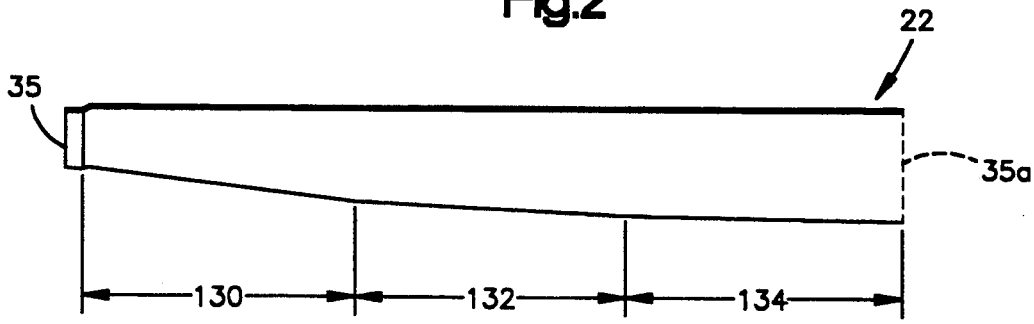
FIG. 6 is an elevational view of an alternative embodiment of an inner element for the trench drain embodying the invention.

In one preferred embodiment, the inner element 22 has a longitudinal slope of 1.09 percent. In an alternative embodiment, there is a variable longitudinal slope that provides a self-cleaning feature and, in addition, maximizes the flow capacity and velocity in the channel. As illustrated in FIG. 6, a first upstream portion 130 of the inner element has a slope of between 1 and 1.5 percent, an adjacent second portion 132 has a slope 25 percent less than the preceding first portion, and a third and final portion 134 has a slope 50 percent less than the first portion.

Satisfactory polymer composites or so-called concretes, and adhesive sealants, of types useful for the present safety trench drain in forming the outer element 24 and adhering adjacent sections of the outer element together and sealing interfaces therebetween, have been used by ACO Polymer Products, Inc., Chagrin Falls, Ohio, the assignee of this application, for other precast trench drain systems and are known in the art. The polymer composites are comprised of a base liquid polymer resin, a mineral or synthetic aggregate filler, a catalyst and an accelerator. The mixture is polymerized through chemical reaction in a mold. Preferred embodiments of the present invention, in order to achieve the desired chemical resistance, utilize vinyl ester resin (a vinyl polymer) or polyester resin, each composition having somewhat different chemical resistance for different applications, and a quartz filler. The preferred sealant is elastomeric, adhesive and chemically resistant, comprised of a vinyl ester and is marketed by ACO Polymer Products, Inc. under the trademark "Vinyl-Seal."

The inner element 22 is preferably made from fiberglass and vacuum formed.

The polymer concrete of either preferred composition has a compressive strength of approximately 14,000 psi or greater (ASTM C39-84), a tensile strength of approximately 1,500 psi or greater (ASTM C78-84), and a moisture absorption of less than 0.2 (surface wetting only) (ASTM C140-75).

It is contemplated that other suitable materials having satisfactory properties may be used and that modifications or alterations may be made in the particular embodiments disclosed, without departing from the spirit and scope of the invention set forth in the claims.

I claim:

1. An elongate safety conduit for collecting liquids, comprising:

a. first and second conduit elements each in the form of an open-topped channel-shaped member having a first end and a second end and substantially liquid impermeable bottom and sidewall portions;

b. the first conduit element located and retained within the second and constructed and arranged to receive liquid through the open top;

c. the second conduit element enveloping the first;

d. support means for supporting the first conduit element within the second conduit element wherein at least a portion of the outside bottom surface of the first element is above the inside bottom surface of the second to provide a space therebetween, said space extending essentially the length of said conduit and suitable for collecting liquid that may leak through the first element;

e. each element being formed of discrete sections having interengaging ends;

f. the distance between the first conduit element inner bottom surface and the second conduit element inner bottom surface decreasing in a longitudinal direction extending from the first end to the second end; and g. means sealing interengaging ends of said sections against leakage.

2. The conduit of claim 1 wherein the inner bottom surface of at least one section of the first conduit element has a greater longitudinal slope relative to the second conduit element inner bottom surface than a subsequent section.

3. A conduit as set forth in claim 1 wherein the sidewalls of the second element extend above the sidewalls of the first.

4. The conduit of claim 1 wherein said support means comprises a transverse surface of each first element sidewall overlapping a transverse surface of an adjacent second element sidewall.

5. A conduit as set forth in claim 1 wherein the inside bottom surface of both elements is at least in part sloped transversely.

6. The conduit of claim 1 wherein the sidewall portions of the second element include transverse surfaces above and laterally outward of and sloped inwardly toward the first conduit element.

7. The conduit of claim 1 further including a seal along the length of the conduit between the two conduit elements at or adjacent to the support means to inhibit entry of liquid between the elements.

8. The conduit of claim 7 wherein the first conduit element has longitudinally extending lateral flanges adjacent the upper side walls that extend over and are supported by transverse longitudinally extending surfaces of the second conduit element and said seal comprises a seal element between each said lateral flange and each said longitudinally extending surface.

9. An elongate safety conduit for receiving liquids, comprising:

a. first and second conduit elements each in the form of an open-topped channel having imperforate bottom and sidewall portions;

b. the first conduit element located and retained within the second and constructed and arranged to allow liquid access thereto from outside the second;

c. the second conduit element bottom and side wall portions enveloping those of the first, the second conduit element sidewall portions including transverse surfaces above and laterally outward of and sloped inwardly toward the first conduit element;

d. support means for supporting the first conduit element within the second conduit element wherein at least a portion of the outside bottom surface of the first element is above the inside bottom surface of the second to provide a space therebetween, said space extending essentially the length of said conduit, and suitable for collecting liquid that may leak through the first element;

e. seal means along the length of the conduit between the two conduit elements at or adjacent to the support means to inhibit entry of liquid between the elements;

f. each element being formed of discrete sections having interengaging ends;

g. side walls of the first conduit element varying in vertical height and sidewalls of the second conduit element being constant in height so that the first element slopes longitudinally from a first end to a second end relative to the second element;

h. means sealing interengaging ends of said sections against leakage;

i. means including a top surface of each first element sidewall for supporting a conduit cover;

j. a perforate conduit cover supported by said means; and k. longitudinally extending guide means for locating the cover in the transverse direction of the conduit.

10. The conduit of claim 9 wherein a section of the first conduit element has a greater average longitudinal slope than a subsequent adjacent section.

11. The conduit of claim 9 wherein the first conduit element has longitudinally extending lateral flanges adjacent the upper side walls that extend over and are supported by transverse longitudinally extending surfaces of the second conduit element and said seal means comprises a seal element between each said lateral flange and each said longitudinally extending surface.

12. The conduit of claim 9 wherein said guide means include frame rails which cooperate with said element top surfaces to locate the cover transversely to the conduit.

13. A conduit as set forth in claim 9 wherein the inside bottom surface of both elements is at least in part sloped transversely.

14. A conduit as set forth in claim 9 including a liquid detector in said space between the elements.

15. An elongate safety conduit for receiving liquids, comprising:

a. first and second conduit elements each in the form of an open-topped channel having imperforate bottom and sidewall portions;

b. the first conduit element located and retained within the second and constructed and arranged to allow liquid access thereto from outside the second, the inside bottom surface of the first element being at least in part sloped transversely;

c. the second conduit element bottom and side wall portions enveloping those of the first, the second conduit element sidewall portions including transverse surfaces above and laterally outward of and sloped inwardly toward the first conduit element, the inside bottom surface of the second element being at least in part sloped transversely;

d. support means for supporting the first conduit element within the second conduit element wherein at least a portion of the outside bottom surface of the first element is above the inside bottom surface of the second to provide a space therebetween, said space extending essentially the length of said conduit and suitable for collecting liquid that may leak through the first element, said means comprising longitudinally extending lateral flanges adjacent the first element upper sidewalls that extend over and are supported by transverse longitudinally extending surfaces of the second element, said space extending essentially the length of said conduit, and suitable for collecting liquid that may leak through the first element;

e. means to detect liquid in said space at the bottom of the sloped part of the inside bottom surface of the second element;

f. each element being formed of discrete sections having interengaging ends;

g. side walls of the first conduit element varying in vertical height and sidewalls of the second conduit element being constant in height so that the first element slopes longitudinally from a first end to a second end relative to the second element;

h. means adhering interengaged ends of said sections and sealing against liquid flow therebetween;

i. frame rails for supporting a cover, the frame cooperating with the first element transverse surfaces to locate the cover transversely to the conduit, the cover being supported such that a top surface of the cover is flush with a ground surface;

j. a perforate cover supported on the frame rails; and k. a seal element between said lateral flanges and said longitudinally extending surfaces.

16. The conduit of claim 15 wherein a section of the first conduit element has a greater average longitudinal slope than a subsequent adjacent section.

* * * * *